US010605442B2

(12) United States Patent
Bader et al.

(10) Patent No.: US 10,605,442 B2
(45) Date of Patent: Mar. 31, 2020

(54) MOUNTING DEVICE FOR MOUNTING HOLDING RAILS FOR LAMPS

(71) Applicant: ZUMTOBEL LIGHTING GMBH, Dornbirn (AT)

(72) Inventors: Martin Bader, Dornbirn (AT); Wolfgang Bechter, Hittisau (AT); Wolfgang Gadner, Horbranz (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 298 days.

(21) Appl. No.: 15/524,312

(22) PCT Filed: Dec. 11, 2015

(86) PCT No.: PCT/EP2015/079402
§ 371 (c)(1),
(2) Date: May 4, 2017

(87) PCT Pub. No.: WO2016/096649
PCT Pub. Date: Jun. 23, 2016

(65) Prior Publication Data

US 2017/0321871 A1 Nov. 9, 2017

(30) Foreign Application Priority Data

Dec. 17, 2014 (DE) ..... 20 2014 106 103 U

(51) Int. Cl.
*F21V 21/34* (2006.01)
*E04B 9/00* (2006.01)
(Continued)

(52) U.S. Cl.
CPC ..... *F21V 21/34* (2013.01); *E04B 9/006* (2013.01); *F21S 8/02* (2013.01); *F21S 8/036* (2013.01); *F21S 8/043* (2013.01)

(58) Field of Classification Search
CPC .. F21V 21/34; E04B 9/006; F21S 8/02; F21S 8/036; F21S 8/043
(Continued)

(56) References Cited

U.S. PATENT DOCUMENTS 5,927,041 A * 7/1999 Sedlmeier ..... E04B 9/064 248/49
2003/0089828 A1* 5/2003 Korczak ..... F16B 21/075 248/68.1
(Continued)

FOREIGN PATENT DOCUMENTS

DE 3836611 5/1990
DE 10124000 12/2002
(Continued)

OTHER PUBLICATIONS

German search report in priority German Application 20 2014 106 103.7 dated Jul. 27, 2015.
(Continued)

*Primary Examiner* — Anh T Mai
*Assistant Examiner* — Jessica M Apenteng
(74) *Attorney, Agent, or Firm* — Andrus Intellectual Property Law

(57) ABSTRACT

The invention relates to a mounting device (1) for mounting holding rails (4*a*, 4*b*) for lamp housings to cut-outs (3) of suspended walls or ceilings, comprising a substantially rigid frame (15) and, connected thereto, a first holder (2*a*) for retaining a first holding rail (4*a*) and a second holder (2*b*) for retaining a second holding rail (4*b*), wherein the holders (2*a*, 2*b*) are designed to hold the holding rails (4*a*, 4*b*) parallel to and at a defined distance from each other. The invention further relates to a mounting system, comprising a mounting device (1) according to the invention and at least two holding rails (4*a*, 4*b*).

12 Claims, 3 Drawing Sheets

(51) Int. Cl.
*F21S 8/02* (2006.01)
*F21S 8/00* (2006.01)
*F21S 8/04* (2006.01)

(58) Field of Classification Search
USPC ..... 362/418
See application file for complete search history.

(56) References Cited

U.S. PATENT DOCUMENTS

2006/0245186 A1* 11/2006 Stillman ..... F21L 14/026 362/225
2016/0033099 A1* 2/2016 Bergman ..... F21S 8/061 362/236

FOREIGN PATENT DOCUMENTS

| | | |
|---|---|---|
| DE | 10145499 | 4/2003 |
| DE | 20 2011 004705 | 7/2011 |
| DE | 20 2012 102902 | 1/2014 |
| EP | 0413212 | 2/1991 |
| WO | 2014 020015 | 2/2014 |

OTHER PUBLICATIONS

International Search Report in parent PCT Application PCT/EP2015/079402 dated Mar. 10, 2016.
Austria search report dated Sep. 6, 2018 in co-pending Austria Patent Application GM 17812015.

* cited by examiner

MOUNTING DEVICE FOR MOUNTING HOLDING RAILS FOR LAMPS

CROSS REFERENCE TO RELATED APPLICATION

The present application is the U.S. national stage application of International Application PCT/EP2015/079402, filed Dec. 11, 2015, which international application was published on Jun. 23, 2016 as International Publication WO 2016/096649 A1. The International Application claims priority to German Patent Application 20 2014 106 103.7, filed Dec. 17, 2014.

FIELD OF THE INVENTION

The invention relates to a mounting device for retaining receiving rails for lamps during the installation of the receiving rails on a suspended wall or ceiling.

BACKGROUND OF THE INVENTION

Conventionally, built-in lamps for suspended ceilings and walls are attached directly to a cut-out in the suspended ceiling or wall. For this, the drywall hanger must first prepare a cut-out, in which the electrician subsequently installs the lamp. After this, the drywall hanger must again plaster the lamp flush with the surface. This solution is complicated, not only because the two builders must interact, but because there is also a tendency of crack formation.

WO 2014/020015 A1 discloses such an installation system.

SUMMARY OF THE INVENTION

In order to overcome the difficulties specified above, a novel mounting system for a thermally decoupled installation of lamps has been developed. The novel mounting system makes use of receiving rails, which are installed at a defined spacing on a cut-out in a suspended ceiling or wall. The receiving rails are preferably plastered in up to a plastering edge. The electrician can insert the lamps directly in the receiving rails prepared thus, without the drywall hanger having to get involved. Further subsequent work by the drywall hanger is unnecessary. Good thermal separation of the lamp from the suspended wall or ceiling is also obtained, because spacing remains between the receiving rails and the edge of the cut-out.

The installation of the receiving rails has remained complicated, however, because a precisely parallel course at a defined spacing in the correct alignment is required in order to be able to install the lamps, which may be from different manufacturers, without difficulty. So far, it has thus been necessary for the drywall hanger to install the receiving rails with great precision, and connect them to the suspended ceiling or wall. This requires a great deal of effort in terms of work time, and is prone to errors, making it impossible to later install the lamps.

The invention thus has the object of creating a mounting device that enables time-saving installation of the receiving rails.

A mounting device according to the invention for receiving rails for lamp housings on cut-outs in suspended walls or ceilings contains a substantially rigid frame, and a first receiving element connected thereto for mounting a receiving rail and a second receiving element for mounting a second receiving rail. The receiving elements are configured to keep the receiving rails parallel to one another thereby, and to keep them at a defined spacing to one another. As a result, during the installation of the receiving rails, the drywall hanger does not have to worry about the receiving rails being parallel or having the proper spacing. A very simple and quick installation of the receiving rails is thus obtained.

The receiving elements are preferably designed to retain the receiving rails individually and/or collectively in a releasable manner, preferably such that they can be released with one hand. In this manner, the installation is further simplified.

Additionally or alternatively, the receiving elements are designed to retain the receiving rails such that they can be slid longitudinally in relation to the mounting device. In this manner, the receiving rails can both be very precisely arranged longitudinally.

Additionally or alternatively, the receiving elements are designed to retain the receiving rails in a defined orientation to one another over their respective longitudinal axes. A particularly reliable alignment of the receiving rails is thus obtained.

The mounting device is preferably designed for installing substantially L-shaped receiving rails, each of which has a first leg that is to be mounted to an undersurface of the suspended ceiling, or the front surface of the suspended wall, and a second leg that engages in the cut-out and supports the lamp housing. In this case, the receiving elements are designed to retain the receiving rails such that the first legs run in one plane, and the second legs are parallel. In this manner, it is ensured that the receiving rails can be installed very easily, and the lamps can later be very easily inserted.

The receiving elements preferably have a first guide profile for receiving a first profile of the respective receiving rail, preferably for receiving the profile of the second leg of the receiving rails. The first guide profiles can be flexible or resilient, and connected to the rigid frame, in particular via resilient arms. A particularly secure retaining of the receiving rails by the mounting device is thus ensured. Furthermore, the guide profile can be readily snapped into the profile of the receiving rail.

The receiving elements preferably each have a second guide profile for receiving a second profile of the respective receiving rail, preferably for receiving a plastering edge of the receiving rail. The second guide profiles are also preferably rigid, and provided in particular as an integral part of the rigid frame, in the form of wings extending laterally from the frame. The wings can furthermore be designed such that they are flush with the receiving rails, in particular with the first legs thereof, when the receiving rails have been inserted. A further improvement of the retaining security is thus achieved. Moreover, as a result of the corresponding elements, and due to the rigid frame, predetermined spacing of two receiving rails is ensured in a simple manner. In particular, in conjunction with the preferably flexible first guide profile, the receiving rail(s) can thus be clamped between the two receiving elements in a simple manner, and thus aligned in a predetermined orientation to one another. For this, the first guide profiles and the second guide profiles are substantially opposite one another, and facing one another, in order to be able to clamp the receiving rails between them. The guide profiles are configured to serve as a guide for sliding the mounting device longitudinally, together with the corresponding elements on the part of the receiving rails.

The mounting device can furthermore have a handle for holding the mounting device, which is preferably attached to the rigid frame. According to one embodiment, this handle can be directly attached to the frame via resilient legs, or via the first guide profiles. In the latter case, it is furthermore possible to manipulate the first guide profiles by means of the handle, thus pivoting the first guide elements inward (toward one another), and thus freeing them for inserting or removing the mounting device.

The receiving elements are preferably designed to retain two respective receiving rails adjoining one another in the longitudinal direction such that they are aligned. In particular, when installing numerous adjoining receiving rails in a shared cut-out in the suspended ceiling or suspended wall, particularly high alignment precision is obtained in this manner.

The receiving elements are preferably designed to receive a receiving rail not yet installed on the suspended ceiling or suspended wall, in order to receive a receiving rail already installed on the suspended ceiling or suspended wall, and to receive a receiving rail not yet installed on the suspended ceiling or suspended wall. In this manner, the drywall hanger can choose between two different installation possibilities. With the first possibility, he first connects two receiving rails to the mounting device, and inserts the receiving rails connected in this manner in the cut-out in the suspended wall or ceiling, in order to then attach them to the suspended wall or suspended ceiling. With the second alternative, the drywall hanger first installs one of the receiving rails on the suspended wall or suspended ceiling in the region of the cut-out, and subsequently inserts the mounting device in the already installed receiving rail. Another receiving rail is subsequently inserted in the second receiving element of the mounting device. This second receiving rail can then be attached to the suspended wall or the suspended ceiling. In this manner, the installation exhibits a great deal of flexibility.

The mounting device is preferably designed as a single piece. Additionally or alternatively, the mounting device is designed as a stamped piece of sheet metal, or as a metal injection-molded part. In this manner, a particularly simple and economical production is ensured.

The mounting device according to the invention is particularly advantageous because a fitting of the second leg of the receiving rails to the edges of the respective cut-out is not necessary. A particularly good thermal separation of the receiving rails from the edges of the suspended ceiling or the border can be obtained in this manner.

A mounting system according to the invention includes a mounting device described above, and at least two receiving rails. A particularly simple installation of the mounting rails and later installation of lamps is thus ensured.

The mounting system preferably has a first mounting device, as described above, and a second mounting device, as described above, and at least two receiving rails. The first mounting device and the second mounting device are configured to retain the receiving rails simultaneously at different positions (e.g. one end of the receiving rails in each case), and to be disposed such that they can slide longitudinally along the receiving rails. In this manner, it is ensured that particularly precise alignment and positioning of the mounting rails is obtained.

BRIEF DESCRIPTION OF THE DRAWINGS

The invention shall be described by way of example below, based on the drawings, in which advantageous exemplary embodiments of the invention are illustrated. Therein.

A detailed description of the construction and the functionality of different exemplary embodiments of the mounting device according to the invention shall be provided below, based on FIGS. 1-3. Not all of the identical elements shall be depicted in similar illustrations and described repeatedly.

DETAILED DESCRIPTION

Figure 1:
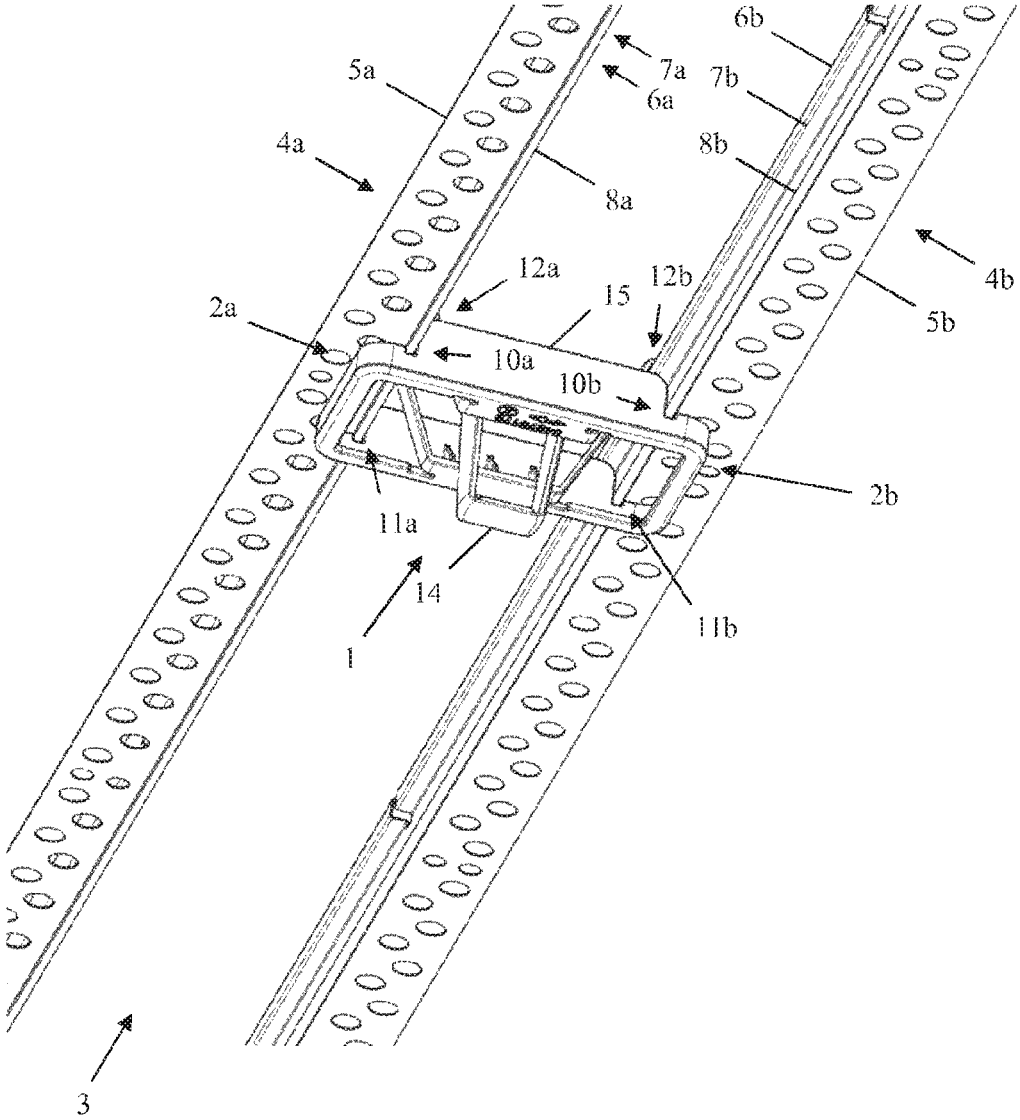
FIG. 1 shows a three-dimensional view of a first exemplary embodiment of the mounting device according to the invention.

A first exemplary embodiment of the mounting device 1 for installing receiving rails 4*a*, 4*b* is depicted in FIG. 1. An installation of the receiving rails 4*a*, 4*b* on a suspended ceiling is illustrated therein. As a matter of course, an identical installation on a suspended wall is likewise possible. The mounting rails 4*a*, 4*b* are attached to the lateral edges of a cut-out 3 in the suspended ceiling, and border on the cut-out 3.

Each of the two receiving rails 4*a*, 4*b* has a first leg 5*a*, 5*b*, which is attached to the suspended ceiling, parallel thereto. Furthermore, each receiving rail 4*a*, 4*b* has a second leg 6*a*, 6*b*, which is disposed at a 90° angle to the first leg 5*a*, 5*b*, and engages in the cut-out 3. The second legs 6*a*, 6*b* are designed to support the lamp housing that is to be installed in the cut-out 3.

The receiving rails 4*a*, 4*b* furthermore have plastering edges 8*a*, 8*b* thereby, which separate the first legs 5*a*, 5*b* from the second legs 6*a*, 6*b*. The plastering edges 8*a*, 8*b* are used to plaster the receiving rails 4*a*, 4*b* flush with the undersurface of the suspended ceiling.

Furthermore, an exemplary embodiment of the mounting device 1 according to the invention is depicted in FIG. 1. The mounting device 1 has receiving elements 2*a*, 2*b*, which serve to retain the receiving rails 4*a*, 4*b*. The receiving rails 4*a*, 4*b* are retained by the receiving elements 2*a*, 2*b* of the mounting device 1, parallel to one another and at a defined spacing. It is thus easily possible to install the receiving rails 4*a*, 4*b* on the edges of the cut-out 3, while they are held by the mounting device 1 in the correct position and orientation.

In particular, the receiving rails 4*a*, 4*b* are held by the receiving elements in a defined orientation to one another about their respective longitudinal axes. I.e., the receiving rails 4*a*, 4*b* are retained such that their respective second legs 6*a*, 6*b* engage in the cut-out 3, while their respective first legs 5*a*, 5*b* lie in a plane parallel to the undersurface of the suspended ceiling.

Preferably, the receiving rails 4*a*, 4*b* can be individually or collectively retained by the receiving elements 2*a*, 2*b* such that they can be released, preferably with one hand. In this manner, the installer can very easily attach the receiving rails 4*a*, 4*b* to the mounting device 1 individually or collectively, and later separate them from the mounting device 1. In particular, because they can be released with one hand, the work sequence is significantly simplified thereby, because the installer can thus use tools with his second hand.

The receiving elements 2*a*, 2*b* each have a first guide profile 12*a*, 12*b*, which is designed to engage in the profiles of the second legs 6*a*, 6*b* of the receiving rails 4*a*, 4*b*, and thus to retain them. The first guide profiles 12*a*, 12*b* are flexible or resilient, in that they are attached via resilient arms 16*a*, 16*b*, 17*a*, 17*b* (see FIG. 3) to the rigid frame 15 of the mounting device 1. Furthermore, the receiving elements 2*a*, 2*b* have second guide profiles 10*a*, 10*b*, 11*a*, 11*b*, which serve to receive the plastering edges 8*a*, 8*b* of the receiving rails 4*a*, 4*b*. The second guide profiles 10*a*, 10*b*, 11*a*, 11*b* are preferably rigid, in that they are provided as an integral part of the rigid frame 15, preferably in wings 18*a*, 18*b* extending laterally away from the frame 15 (see FIG. 2). The wings 18*a*, 18*b* are designed such that they are flush with the receiving rails 4*a*, 4*b*, or the first legs 5*a*, 5*b* thereof, when the receiving rails 4*a*, 4*b* have been inserted. There are two second guide profiles 10*a*, 10*b*, 11*a*, 11*b* in each of the receiving elements 2*a*, 2*b* in the exemplary embodiment depicted here. All of the guide profiles 10*a*, 10*b*, 11*a*, 11*b* 12*a*, 12*b* are configured to serve as guides for sliding the mounting device 1 longitudinally in the receiving rails 4*a*, 4*b*, together with the corresponding elements on the part of the receiving rails 4*a*, 4*b*. The first guide profiles 12*a*, 12*b* are substantially opposite the second guide profiles 10*a*, 10*b*, 11*a*, 11*b*, and face one another. The receiving rails 4*a*, 4*b* can thus be clamped between the guide profiles 10*a*, 10*b*, 11*a*, 11*b*, 12*a*, 12*b*.

A very secure, readily releasable and substantially stable retaining of the receiving rails 4*a*, 4*b* during the installation process is ensured by the retaining of the receiving rails 4*a*, 4*b* by the guide profiles 10*a*, 10*b*, 11*a*, 11*b*, 12*a*, 12*b* of the receiving elements 2*a*, 2*b* of the mounting device 1.

If a particularly long cut-out is to be provided with receiving rails 4*a*, 4*b* using the mounting device according to the invention, it may be necessary to connect numerous receiving rails 4*a*, 4*b* to one another in the longitudinal direction. In this case, the mounting device 1 is designed to retain two directly adjoining receiving rails with each receiving element 2*a*, 2*b*, thus retaining a total of four receiving rails 4*a*, 4*b*. In this manner, precise alignment at the transition of adjoining receiving rails 4*a*, 4*b* is ensured.

The installer has numerous options for installing the receiving rails 4*a*, 4*b*. On one hand, he can connect two not yet installed receiving rails 4*a*, 4*b* to the receiving elements 2*a*, 2*b* of the mounting device 1, and place the receiving rails 4*a*, 4*b* connected in this manner collectively in the cut-out 3. He can then attach both receiving rails simultaneously to the edges of the cut-out 3.

Alternatively, the installer can connect one receiving rail 4*a*, 4*b* to an edge of the cut-out 3, and subsequently connect the already installed receiving rail 4*a*, 4*b* to the mounting device 1, and to a not yet installed receiving rail 4*a*, 4*b* by means of the mounting device.

The mounting device 1 is preferably designed to be operated with one hand. For this, the mounting device 1 has a handle 14, which is preferably connected to the frame 15 and is used to hold the mounting device 1, and thus the receiving rails 4*a*, 4*b* connected thereto. In a preferred embodiment, shown in the Figures, the handle 14 is connected to the frame 15 by means of resilient legs 13*a*, 13*b* via the first guide profiles 12*a*, 12*b*. In this case, the handle 14 can preferably also serve to release and attach the receiving rails 4*a*, 4*b* from and to the receiving elements 2*a*, 2*b*. By pressing the respective two legs 13*a*, 13*b* of the handle 14 connected to one of the opposite first legs 12*a*, 12*b* together, the guide profiles 12*a*, 12*b* are pushed away from the profiles 7*a*, 7*b* of the second legs 6*a*, 6*b* of the receiving rails 4*a*, 4*b*, and exposed toward the second guide profiles 10*a*, 10*b*, 11*a*, 11*b*, by means of which the receiving rails 4*a*, 4*b* no longer sit securely in the receiving elements 2*a*, 2*b*.

Preferably, the receiving rails 4*a*, 4*b* can be slid longitudinally in the receiving elements 2*a*, 2*b* when in the connected state. In this manner, a particularly simple adjustment of the position along the edges of the cut-out 3 can be obtained.

A mounting system according to the invention contains at least one mounting device 1, and at least two receiving rails 4*a*, 4*b*. Alternatively, the mounting system can also include numerous mounting devices 1. This is useful in particular with very long receiving rails 4*a*, 4*b*, because with very long receiving rails 4*a*, 4*b*, there may be strong shearing forces exerted on the receiving elements 2*a*, 2*b*. A more stable, and especially a more torsion resistant, attachment of the receiving rails 4*a*, 4*b* can be obtained in this manner.

Alternatively, with a mounting system having just one mounting device 1 for installing the receiving rails 4*a*, 4*b*, it is possible to proceed such that the mounting device 1 is first attached to a common end of the two receiving rails 4*a*, 4*b*. The receiving rails 4*a*, 4*b* are then attached at these ends to the edges of the cut-out 3. The mounting device 1 is then slid along the length of the receiving rails 4*a*, 4*b*. This automatically results in a parallel and correct course of the receiving rails 4*a*, 4*b*. The receiving rails 4*a*, 4*b* can then be connected to the edges of the cut-out 3 at regular intervals. In this manner, very long receiving rails 4*a*, 4*b* can then be connected to the edges of the cut-out 3 as well. Very long receiving rails 4*a*, 4*b* can also be correctly installed in this manner, using just one mounting device 1.

The guide profiles 12*a*, 12*b* are preferably formed as an integral part of the frame 15 of the mounting device 1. They are preferably connected to one another by a connecting bridge on the side of the mounting device 1 facing away from the suspended wall or ceiling. As a result, a one-handed installation, and in particular a one-handed releasing and connecting of the receiving rails 4*a*, 4*b* from and to the mounting device 1 is enabled. In the exemplary embodiment depicted here, the connecting bridge is a part of the handle 14.

After installing the receiving rails 4*a*, 4*b* on the suspended ceiling or the suspended wall in the region of the cut-out 3, the mounting device 1 can be removed by releasing the receiving elements 2*a*, 2*b*. Subsequently, the receiving rails 4*a*, 4*b* can be plastered in along the plastering edges 8*a*, 8*b*. The task of the drywall hanger is then completed. A later refinishing after installation of the lamps is not necessary.

Figure 2:
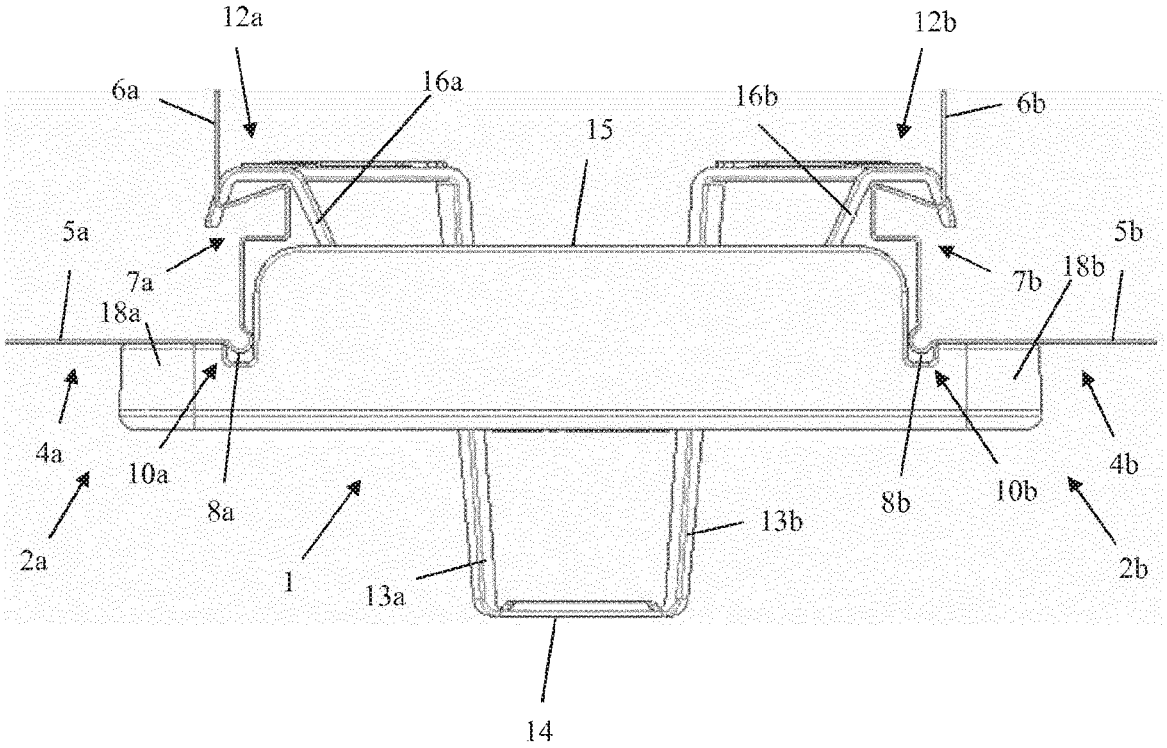
FIG. 2 shows a side view of a second exemplary embodiment of the mounting device according to the invention.
Figure 3:
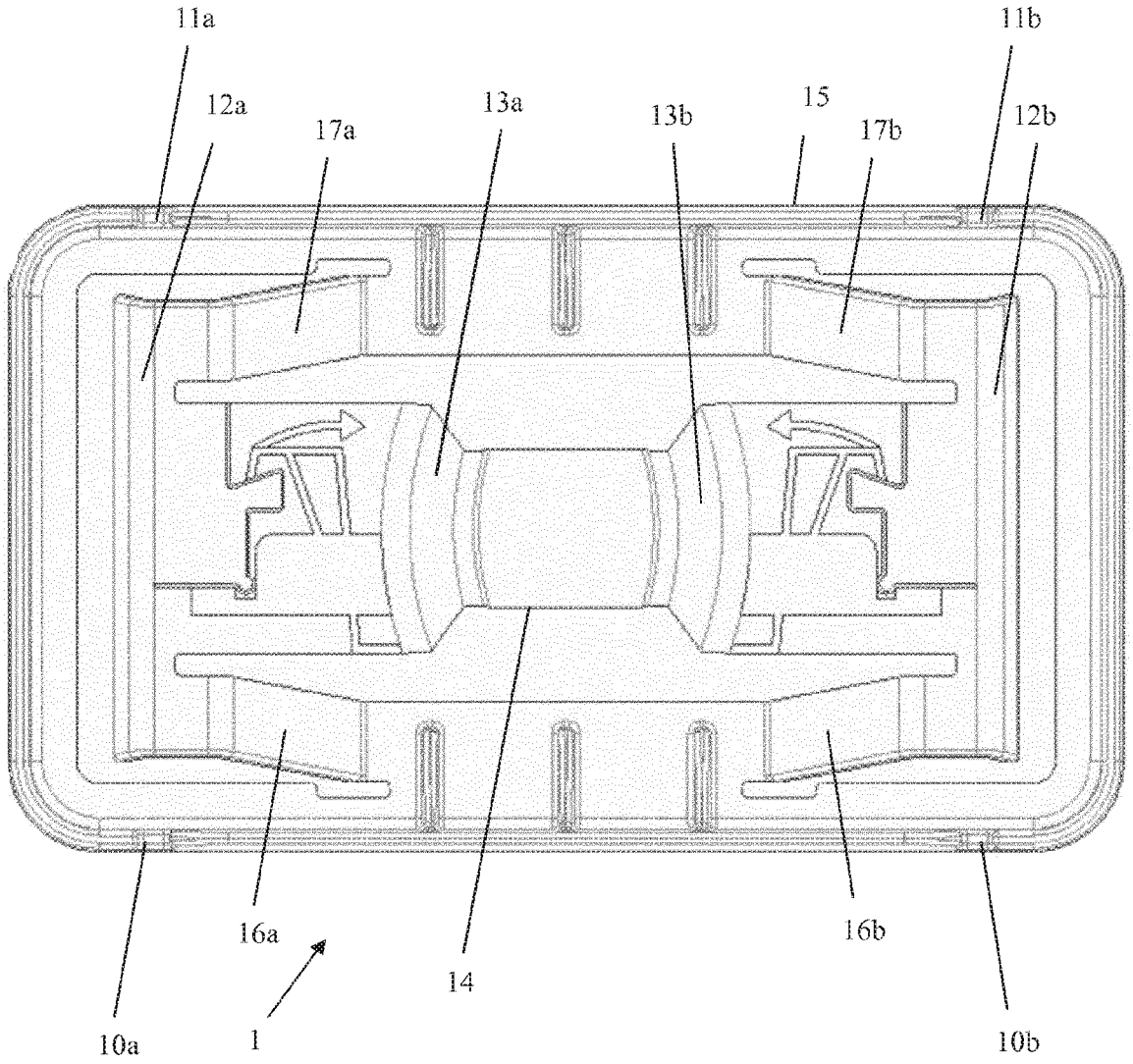
FIG. 3 shows a top view of a third exemplary embodiment of the mounting device according to the invention.

A side view of the mounting device 1 depicted in FIG. 1 is shown in FIG. 2. A top view of the mounting device 1 shown in FIG. 1 and FIG. 2 is depicted in FIG. 3.

The invention is not limited to the depicted exemplary embodiment. In particular, structural elements other than lamps can also be installed using the receiving elements. The use of more than one mounting device is also conceivable. In particular, it is also conceivable to deliver the receiving rails already connected to one or more mounting devices. All of the features described above or shown in the Figures can be advantageously combined with one another in an arbitrary manner within the scope of the invention.

What is claimed is:

1. A mounting device (1) for installing receiving rails (4*a*, 4*b*) for lamp housings into cut-outs (3) in suspended walls or ceilings, the mounting device being releasable and comprising:

a substantially rigid frame (15), and connected thereto a first receiving element (2*a*) for retaining a first receiving rail (4*a*), and a second receiving element (2*b*) for retaining a second receiving rail (4*b*)

wherein the first and second receiving elements (2*a*, 2*b*) on the mounting device (1) are configured to retain the first and second receiving rails (4*a*, 4*b*) parallel and at a defined spacing to one another, and the first and second receiving rails (4*a*, 4*b*) are each configured with a substantially L-shaped cross section, such that each receiving rail (4*a*,4*b*) has a first leg (5*a*, 5*b*) for mounting it to the undersurface of the suspended wall or a front surface of the suspended wall, a second leg (6*a*, 6*b*) for engaging in the cut-out (3) and for supporting the lamp housing, and a plastering edge (8*a*, 8*b*) at the intersection of the first (5*a*,5*b*) and second leg (6*a*, 6*b*), and further wherein the first and second receiving elements (2*a*, 2*b*) are configured to retain the first and second receiving rails (4*a*, 4*b*) such that the first legs (5*a*, 5*b*) run in a plane parallel to the wall or ceiling and the second legs (6*a*, 6*b*) extend into the cut out; and wherein the first and second receiving elements (2*a*, 2*b*) on the mounting device (1) each have a first profile guide (12*a*, 12*b*) connected to the rigid frame (15) via resilient arms (16*a*, 16*b*, 17*a*, 17*b*) and at least one second profile guide (10*a*, 10*b*, 11*a*, 11*b*), and the first profile guide clamps the mounting device to the respective receiving rail with the respective second profile guides engaging the respective plastering edge; and the first and second receiving elements (2*a*, 2*b*) retain the clamped first and second receiving rails (4*a*, 4*b*) in a defined orientation to one another about their respective longitudinal axes.

2. The mounting device (1) according to claim 1, wherein the first and second receiving elements (2*a*, 2*b*) are configured to retain the first and second receiving rails (4*a*, 4*b*) individually and/or collectively such that they can each be released, such that they can be released with one hand, and/or to retain the first and second receiving rails (4*a*, 4*b*) such that they can each be displaced longitudinally in relation to the mounting device (1).

3. The mounting device (1) according to claim 1 wherein the first profile guides (12*a*, 12*b*) on the respective first and second receiving element (2*a*, 2*b*) on the mounting device are configured to receive a first profile (7*a*, 7*b*) of the second leg (6*a*, 6*b*) of the respective first and second receiving rail (4*a*, 4*b*).

4. The mounting device (1) according to claim 3 wherein the mounting device (1) also has a handle (14), which is connected to the rigid frame (15) via the first profile guides (12*a*, 12*b*), by means of resilient legs (13*a*, 13*b*), and is used to hold the mounting device (1).

5. The mounting device according to claim 1 wherein the pair of second profile guides (10*a*, 11*a* and 10*b*, 11*b*) are located on each of the first and second receiving elements and each pair is configured to receive the plastering edge of the respective clamped first and second receiving rail in order to maintain the alignment and the spacing of the clamped first and second receiving rails.

6. The mounting device (1) according to claim 1 wherein the second profile guides (10*a*, 10*b*, 11*a*, 11*b*) are rigid, and provided as an integral part of the rigid frame (15) in wings extending laterally away from the frame (15), and wherein the wings (18*a*, 18*b*) are flush with the first legs (5*a*, 5*b*) of the first and second receiving rails (4*a*, 4*b*), when the first and second receiving rails (4*a*, 4*b*) have been inserted.

7. The mounting device (1) according to claim 6 wherein the profile guides (10*a*, 10*b*, 11*a*, 11*b*, 12*a*, 12*b*) serve as a guide, together with the corresponding elements (7*a*, 7*b*, 8*a*, 8*b*) on the part of the first and second receiving rails (4*a*, 4*b*), for sliding the mounting device (1) longitudinally along the first and second receiving rails (4*a*, 4*b*).

8. The mounting device (1) according to claim 7 wherein the first profile guides (12*a*, 12*b*) are substantially opposite the second profile guides (10*a*, 10*b*, 11*a*, 11*b*) and face one another, in order to be able to clamp the first and second receiving rails (4*a*, 4*b*) between them by means of the guide profiles (10*a*, 10*b*, 11*a*, 11*b*, 12*a*, 12*b*).

9. The mounting device (1) according to claim 1 wherein the receiving elements (2*a*, 2*b*) are each configured to simultaneously retain two longitudinally adjoining receiving rails (4*a*, 4*b*) aligned with one another.

10. The mounting device (1) according to claim 1 wherein the first and second receiving elements (2*a*, 2*b*) are each configured to each receive the first and second receiving rail (4*a*, 4*b*) respectively not yet installed on the suspended ceiling or suspended wall, and to receive the first or second receiving rail (4*a*, 4*b*) already installed on the suspended ceiling or suspended wall, and the other receiving rail of the first and second receiving rails (4*a*, 4*b*) not yet installed on the suspended ceiling or suspended wall.

11. The mounting device (1) according to claim 1 wherein the mounting device (1) has a single-piece design, and the mounting device (1) is produced as a stamped sheet metal or metal injection-molded part, or as a plastic injection-molded part.

12. A mounting system having a first mounting device (1) according to claim 1 further comprising a second mounting device (1), wherein the first mounting device (1) and the second mounting device (1) are configured to simultaneously retain the first and second receiving rails (4*a*, 4*b*) at different positions of an end of the first and second receiving rails (4*a*, 4*b*) and to be disposed such that each mounting device can be slid longitudinally along the first and second receiving rails (4*a*, 4*b*).

* * * * *